US007377499B2

(12) United States Patent
Pakdaman

(10) Patent No.: US 7,377,499 B2
(45) Date of Patent: May 27, 2008

(54) GAS ENRICHMENT MODULE

(76) Inventor: Abolghassem Pakdaman, Poehlenweg 29, Duesseldorf (DE) 40629

( * ) Notice: Subject to any disclaimer, the term of this patent is extended or adjusted under 35 U.S.C. 154(b) by 148 days.

(21) Appl. No.: 10/516,353

(22) PCT Filed: Jun. 18, 2003

(86) PCT No.: PCT/EP03/06452

§ 371 (c)(1),
(2), (4) Date: Jun. 9, 2005

(87) PCT Pub. No.: WO04/000448

PCT Pub. Date: Dec. 31, 2003

(65) Prior Publication Data

US 2006/0244160 A1 Nov. 2, 2006

(30) Foreign Application Priority Data

Jun. 21, 2002 (DE) ..... 102 27 818

(51) Int. Cl.
*B01F 3/04* (2006.01)

(52) U.S. Cl. ..... 261/122.1; 261/123; 261/124; 366/181.5; 366/181.6; 366/340

(58) Field of Classification Search ..... 261/122.1, 261/123, 124, 126; 366/181.5, 181.6, 340, 366/341
See application file for complete search history.

(56) References Cited

U.S. PATENT DOCUMENTS 643,396 A * 2/1900 Birdsall et al. ..... 96/120
813,414 A * 2/1906 Fox ..... 261/70
824,956 A * 7/1906 Smith ..... 261/19
1,737,336 A * 11/1929 Sager ..... 261/123
2,176,558 A * 10/1939 Lockey ..... 261/122.1
2,305,796 A * 12/1942 Seidel ..... 261/122.1
2,637,541 A * 5/1953 Rubin ..... 261/122.1
4,067,696 A * 1/1978 Curtis ..... 422/47
4,068,830 A * 1/1978 Gray ..... 366/175.2
4,624,791 A * 11/1986 Ferriss ..... 210/704
4,674,888 A 6/1987 Carlson
4,735,709 A 4/1988 Zipperian
4,869,849 A * 9/1989 Hirose et al. ..... 261/78.2
5,356,565 A * 10/1994 Southwell ..... 516/10
6,447,158 B1 * 9/2002 Farkas ..... 366/316

FOREIGN PATENT DOCUMENTS

DE 29822696 4/1999
WO WO 01/81832 A1 11/2001

OTHER PUBLICATIONS

PCT International Search Report for PCT/EP03/06452, four pages, 2003.

* cited by examiner

*Primary Examiner*—Scott Bushey
(74) *Attorney, Agent, or Firm*—Rankin, Hill & Clark LLP

(57) ABSTRACT

The invention relates to a device for the gas enrichment of fluids, to a method for producing fluids that are enriched with gases and to the use of the aforementioned device in human and veterinary medicine and the pharmaceutical, foodstuff cosmetic and environmental industries. The invention has a wide range of applications as a result of the salutary and prophylactic action produced by the effective gas enrichment of the fluids enriched by means of the inventive device. In addition, the inventive device has a simple construction, making it cost-effective to produce, easy to operate and portable and allowing the fluids thus enriched to be rapidly available.

19 Claims, 14 Drawing Sheets

GAS ENRICHMENT MODULE

The invention relates to a device for gaseous enrichment of fluids, a method for manufacturing fluids enriched with gases, the use of the named device in human and veterinary medicine, in the pharmaceutical industry, in the foodstuffs industry, cosmetics, environmental research, environmental technology and in the environmental industry.

Aerobic life on earth was and is a revolutionary stage in the evolution of the world; it began, inter alia, with the assistance of oxygen, hydrogen, nitrogen, carbon, water and photons.

The stage prior to the appearance of life occurred as an existential, natural process resulting from the Big Bang.

The Big Bang and the massive quantity of energy released were followed by a transformation of material into gaseous, vaporous, liquid and solid components, thereby establishing the first building blocks for atomic, molecular and cellular life.

In the primeval atmosphere, oxygen became an existential element, which represents the basis of life for all aerobic organisms.

Oxygen is a highly potent element, which is necessary for life and which, in combination with the mitochondrial respiratory chain, is capable, inter alia, of realising energy recovery via ATP. Oxygen functions as an information carrier and provides, inter alia, a quantum effect.

Moreover, the history and development of science and technology show and/or confirm that a connection exists between gaseous, liquid and solid media as the principal components of the earth, on the one hand, and photons, on the other hand. Furthermore, as energy carriers of the world, they represent a macrocosm by comparison with microcosm of the human body.

Against this background, it has been shown that, for example, pharmaceutical agents, foodstuffs and cosmetic products enriched with gases provide an expanded spectrum of action and increased efficacy.

The object of the present invention is to create a device for gaseous enrichment of fluids, and a method for using the named device, which can be manufactured and used in a comparatively simple and cost favourable manner, and which allows effective gaseous enrichment, wherein "effective" should be understood to mean that a large proportion of gas is dissolved in the fluid, and also that this proportion of gas is retained for a comparatively long period during the time following the gaseous enrichment.

The object of the invention is achieved by a device with the features of claim 1 and/or by a method according to the corresponding method claim.

Advantageous embodiments are defined in the dependent claims.

The device for gaseous enrichment according to the invention comprises a container for a fluid, in which the fluid to be enriched with gas, is disposed and/or to which the fluid is supplied. The container can be, for example, a bottle-like, cylindrical or tubular container, preferably manufactured from steel, ceramic or glass.

Furthermore, means are provided for supplying a gas to the container. These means comprise, for example, a gas bottle, in which the gas is stored before the enrichment and a gas line to the container. The gas is supplied to the device, for example, at 3 to 3.5 bar. Furthermore, means are provided for supplying the fluid to the container. For instance, a supply of drinking water can be provided as the supply medium, the supply line, in this case, being connected to the domestic water supply. The fluid is supplied to the device at, for example, 4.5 to 6 bar. The fluid is normally supplied to the device at a greater pressure than the gas.

Inside the container, the means for supplying the gas and/or the fluid have multiple, sieve-like perforations, thereby forming output openings for the gas and/or fluid. The output openings for the gas are therefore preferably disposed in the fluid. The provision of sieve-like, multiple perforations in the gas-supply means achieves an effective dissolution of the gas in the fluid because of the atomising effect. As a result of turbulence effects in the fluid, the sieve-like, multiple perforations in the fluid-supply means achieve an effective dissolution of the gas, which is subsequently added to the fluid in the container.

The container may also have double walls or multiple walls. This means that the gas concentration in the fluid can advantageously be increased.

As a result of the multiple perforation and the associated distribution of the output openings over a wide area, a relatively widely distributed output surface for the gas and/or the fluid is achieved by comparison with a single output opening. Accordingly, multiple perforation allows the fluid to be introduced into the container and/or the gas to be introduced into the fluid over a comparatively wider area.

Furthermore, the multiple perforation of the gas-supply means allows the gas to be introduced into the fluid in a similar manner to a shower-head, wherein the gas throughput is distributed over the multiple perforations and, accordingly, the rate of introduction at the individual perforations is reduced by comparison with a single gas-output opening with the same gas throughput. As a result, a particularly even, turbulence-free introduction of gas into the fluid is achieved by comparison. Furthermore, each individual, relatively small perforation is surrounded by fluid, in which the gas can be dissolved. In this respect, alongside an expanded gaseous enrichment, the multiple perforations additionally achieve a particularly even and effective gaseous enrichment of the fluid because of the distribution of the output openings over a wide area.

Alongside this, the multiple perforations allow an increased gas and/or fluid throughput by comparison with a single output opening, especially if the area of all the output openings is larger than a single output opening as a result of the multiple perforations.

In the context of the present invention, "fluid" should be understood in a broad sense to include liquids, such as drinking water, blood, sera, injection solutions, suspensions, but also fluids of greater viscosity, such as, cosmetic lotions and creams. For instance, if drinking water is enriched with gas, it can be specially pre-purified through filters in the fluid-supply means, for example, the nitrate, heavy metal, pesticide or insecticide content etc. can be reduced. The relevant gases include, for example, oxygen, carbon dioxide, nitrogen, hydrogen, argon, helium, neon, krypton, radon, ozone and xenon. The oxygen can be used in molecular $O_2$ form, in ionised form or also in singlet form.

Furthermore, a fluid outflow is provided, through which the enriched fluid is released from the container.

Moreover, the device according to the invention is characterised in that it can be put into operation quickly because of the comparatively simple structure. Furthermore, the device is easy to operate and can easily be cleaned, for example, using disinfectant agents. The device is preferably operated to meet the corresponding hygiene regulations, which are readily fulfilled because of the design according to the invention.

In a further embodiment of the invention, several output regions with multiple, sieve-like perforations, across which the gas and/or fluid is supplied, are provided separately from one another. As a result of the multi-directional supply of gas and/or fluid achieved in this manner, the fluid is enriched in a particularly effective manner. Furthermore, several output regions can be provided to supply different gases and/or fluids, especially if it is technically difficult or impossible to mix the latter before the gaseous enrichment.

In one advantageous embodiment of the device according to the invention, the container is subdivided into volumetric portions, the subdivision being achieved by one or more walls with sieve-like, multiple perforations. A particularly effective enrichment is achieved if several walls are provided. For example, an effective gaseous enrichment is achieved with a number from 50 to 60 perforated walls. The wall or walls respectively is/are preferably arranged in such a manner that when flowing from the supply means to the outflow, the fluid and gas flow through the perforations of the wall or walls respectively. The walls with multiple perforations are spaced at such a distance from one another that, after the fluid has passed through the perforations of each wall, an adequate turbulence is produced to achieve an effective enrichment. In practical experiments, a distance from 1 to 2 mm between the walls forming a subdivision has proved to be suitable. The walls may consist, for example, of wire mesh or perforated glass, ceramic or synthetic-material plates.

In another advantageous embodiment, several sieve-like, walls with multiple perforations are provided in the container, these walls being perforated at least partially differently from one another. For example, the walls are made from different wire meshes, each of which provides several perforations (pores) of 64 μm and 0.1 mm diameter (pore size) respectively. With a combination of differently perforated walls, the fluid is subjected to particularly strong turbulence when flowing through each of the different perforations, which results in a particularly effective enrichment.

In a further advantageous embodiment, several sorts of differently perforated walls are provided. These are spatially arranged in periodic alternation. As a result, when seen in the direction of flow of the fluid, repeating sequences of walls, which have different perforation diameters within a sequence, are provided. As a result, during the course of its flow from the supply means to the outflow, the fluid is subjected to different but periodically repeating flow conditions at the walls. As a result of the periodic flow conditions and the resulting flow behaviour of the fluid, particularly good conditions are provided for gaseous enrichment.

In a further advantageous embodiment, the means for supplying the fluid or gas are designed in multiple layers and, from layer to layer provide portions with different sieve-like, multiple perforations, which form the output openings. This means that the fluid and/or gas is already in strong turbulence during its supply to the container, and accordingly, a powerful mixing of gas and fluid is achieved. For this purpose, the supply means can, for example, provide different wire meshes, wherein the diameter of the perforations of each layer of wire mesh decreases when seen in the flow direction of the fluid and/or gas. For instance, a combination of one layer of a coarsely perforated (large mesh) wire mesh of 2 mm perforation diameter (mesh size), a further layer of a more finely perforated wire mesh (also referred to as outflow fabric) with mesh size 0.4 mm and one layer of an extremely fine perforated wire mesh (also referred to as filter fabric) with mesh size 0.60 μm achieves a particularly effective enrichment of gas in the fluid.

In a further advantageous embodiment, the means for supplying the fluid or gas are designed in the form of a tube. Furthermore, the portions which are perforated to form output openings are arranged on the casing area of the tube. Otherwise, no output openings are provided, because, for example, the tube is closed at one end, and accordingly, the fluid which flows into the tube via one end surface is forced to flow into the container through the perforated casing area of the tube. The resulting flow conditions and turbulence in the fluid are particularly favourable for an effective gaseous enrichment.

In a further advantageous embodiment of the invention, the container is designed in a tubular form. This achieves an even velocity profile in the flow characteristic. Relaxed-flow zones, for example, at the edges and in corners, in which bacteria could disadvantageously accumulate, are avoided.

In one advantageous embodiment of the invention, the device is manufactured largely from V2A steel. As a result, in addition to resistance to rust, the device provides adequate hygiene for use with foodstuffs—for example, for the enrichment of drinking water with oxygen.

In a further advantageous embodiment of the invention, the device is manufactured largely from electro-polished steel. Electro-polished steel provides a relatively low roughness. Additionally, the surfaces of the device are, by comparison, particularly well de-burred as a result of the electro-polishing treatment. The accumulation of contamination or bacteria in the device is avoided.

In a further advantageous embodiment of the invention, the container is designed to be pressure-tight, so that it can be charged with a pressure, for example, by the in-coming gas. Means can also be provided, for placing the container under pressure. The pressure-tight design influences, for example, the material and the wall thickness of the container, and also the design of the openings in the container.

For instance, with the exception of the supply line for the gas, existing openings in the container, provided, for example, to fill and/or to release the fluid, can be designed to be sealed in a pressure-tight manner. For example, the openings are provided with screw closures or bayonet closures and with rubber seals. Alternatively, supply lines and outflow lines to and from the container can be provided with locking valves. This means that the gaseous enrichment can be intensified according to the physical laws of gas kinetics, and when an equilibrium has been established, the enrichment with gas is retained even after enrichment.

In a further embodiment of the device according to the invention, cooling means 40 as shown in FIG. 9 are provided. Cooling pipes, for example, may be provided in or around the container, through which liquid, cooled using an expansion process, is fed; or Peltier elements may be attached to the container. As a result, the gaseous enrichment can be intensified according to the physical laws of gas kinetics.

In a further embodiment of the device according to the invention, the means for supplying the gas are essentially cylindrical, conical, spiral, ellipsoidal, spherical, funnel-shaped, nozzle-shaped or wave-shaped in the region around the output openings for the gas. This means that the gas output openings are distributed over a relatively large area, that is to say, the perforated area is expanded. As a result of this measure, a particularly efficient and even gaseous enrichment is achieved.

A further advantageous variant of the device according to the invention provides at least one valve as a component of the means for supplying the gas. The gas supply can advantageously be interrupted and/or regulated with this valve. Furthermore, if the container is separated from the gas-supply means, then, with an appropriate arrangement of valves, the valve and/or valves can be used to achieve this separation without a loss of gas into the gas-supply means and/or the container. In particular, the gas-supply means, for example, a gas container, can be replaced without loss of gas.

In a further advantageous embodiment of the device according to the invention, the means for supplying the gas is fitted with a manometer 42 as shown in FIG. 9. The pressure of the supplied gas can advantageously be read off and/or monitored in this manner, so that it can be regulated by means of additionally provided means, such as a valve.

In a further advantageous embodiment of the device according to the invention, the means for supplying the gas is fitted with a pressure reducer. As a result, the pressure of the supplied gas can advantageously be reduced and adjusted to a constant level. This achieves a particularly even gaseous enrichment, especially if the fluid is enriched with the gas in a continuous process, that is to say, if the fluid is supplied to and removed from the container continuously.

In another advantageous embodiment of the device according to the invention, the container provides several narrowings. These are arranged in such a manner relative to the gas-output openings that the gas output, and/or the optionally provided fluid supply, causes a flow in the fluid, which has a promoting effect on the gaseous enrichment. For example, the fluid is disposed in a tubular container, fitted with a fluid inlet and a fluid outflow, wherein the container narrows as if it has been tied in several places about its tubular axis. The fluid flows through the tubular container from the fluid inlet to the fluid outflow. In a bulge-like thickening of the tube disposed between two narrowings, the gas is supplied to the fluid via one or more perforated gas-output regions from one side or from more than one side. By arranging the gas-output regions in the resulting bulge-like widenings between the narrowings of the container, the direction of flow of the fluid after each narrowing is deflected especially towards the gas-output openings as a result of the effects of flow behaviour, and therefore achieves a particularly effective gaseous enrichment. In a further embodiment, the output regions are arranged in the narrowings. Because of the increased flow rate of the fluid within the narrowings of the container and the pressure and/or compression effects on the molecules occurring as a result, the fluid is enriched with gas in a particularly effective manner.

In a further embodiment of the device according to the invention, at least one fluid inlet and fluid outflow into and from the container are provided. In addition to simply supplying and removing the fluid into and from the container, this allows both processes to take place simultaneously. As a result, in addition to the time saving gained with a continuous process, the fluid can be enriched evenly, with the same quantity of gas per quantity of fluid flowing through the container.

In a further advantageous embodiment, components of the parts of the gas supply means, which are disposed in the container, are mounted in a rotationally mobile manner. For example, the regions around the output openings rotate about a rotational axis. The axis can be the axis of rotational symmetry of those regions of the output openings for the gas indicated above, which are designed in a rotationally symmetrical form, for example, in a cylindrical, conical, ellipsoidal, spherical, funnel-shaped form. Furthermore, with a spiral region, an axis passing through the centre of the spiral can be provided as the rotational axis, and/or, with a wave-shaped output region, an axis of rotation can be provided in the centre of the wave form in the longitudinal direction of the wave form. The rotationally mobile mounting allows a rotational movement of the output openings thereby achieving a particularly effective and even gaseous enrichment. In one embodiment, the rotational movement is provided with a mechanical drive. In other embodiments, the recoil property of the flow of gas is exploited to obtain a simple device at the same time as achieving a particularly effective gaseous enrichment. For instance, the output openings are arranged appropriately, or each of their output directions is arranged relative to the rotational axis in order to achieve an overall rotational moment with reference to the rotational axis, thereby inducing a rotational movement of the output openings.

In a further variant, the output openings provide different opening sizes. As a result, different flow rates are achieved at the output openings, in order to achieve an overall rotational moment with reference to the rotational axis, thereby inducing a rotational movement of the output openings.

Furthermore, the invention relates to a method for the manufacture of fluids enriched with gas using the device according to the claims. With this method, a fluid enriched with gas can be manufactured in a particularly cost-favourable and efficient manner, for example, for applications in chemistry, biochemistry, physics and biophysics, human medicine, veterinary medicine, in the pharmaceutical and environmental industries. The device and the associated method operate in a particularly environment-friendly manner and can, in particular, be used with existing natural products, such as natural drinking water, on the one hand, and naturally occurring gases on the other hand. At the same time, the comparatively simple device allows the method to be used rapidly thereby manufacturing the enriched fluids in a short time. Further advantageous effects of the method are covered by the named advantages of the embodiments of the device. The term "natural drinking water" is understood to include, inter alia, water from a spring or a source.

Furthermore, the device according to the invention is advantageously used in medicinal and pharmaceutical applications, for example, for gaseous enrichment of blood products, sera, injection solutions, suspensions, drops, lotions, creams or tinctures. Moreover, the gas-enriched fluids can be used as micronutrients or can provide a prophylactic or health-promoting effect or improve the quality of life. The device and/or the associated gas-enriched fluids are used in medicine as a supporting measure in trauma therapy, as an intensifying measure for a pharmaceutical treatment, for example, with antibiotics, and in the treatment of migraine. For example, the device is used in oxygen therapy, for example, peroral oxygen therapy (POT). With peroral oxygen therapy, an optimum absorption and utilisation of oxygen in the body is achieved in order to combat cellular hypoxia as a major problem in the cell. Moreover, an optimum water and electrolyte budget, and harmonisation and maintenance of the body environment is achieved. This method is carried out as a supplementary therapy with conventional and other methods of therapy. Accordingly, the use of POT in patients with ischaemic and hypoxic heart-rhythm disturbances produces positive therapeutic effects. Moreover, in patients with ophthalmic disorders, an improvement, for example, a reversal of a raised intra-ocular pressure, can be achieved. Furthermore, positive effects are found in cancer treatment: hypoxic cancer cells are resistant to radiation therapy and are sensitised to radiation and to many cytostatic agents; as a result, they can therefore be more intensively damaged. An oxygenation of a tumour can be achieved with POT. This method is therefore particularly recommended in the context of a combined, conventional cancer therapy (operation, chemotherapy and radiation therapy). No side-effects are associated with this method. Liver values can be improved and a liver tumour can be treated and/or a successful contribution towards treatment can at least be provided.

Otherwise, the device according to the invention has a very wide range of applications, the embodiment and size of the device being adapted according to the area of application and the quantity of fluid to be enriched with gas. For example, a device with a fluid inlet and a fluid outflow can be used for gaseous enrichment of drinking water, the fluid inlet being connected to the drinking-water supply.

If a mobile use of the device is required, for example, in a vehicle, the device is designed with small dimensions and is not operated continuously, that is to say, the container is filled with fluid; the fluid is then enriched with gas and the enriched fluid is removed.

With a mobile enrichment-system optimised and installed onboard a ship, contaminated and polluted water from rivers and lakes can be purified and enriched with oxygen.

Diagrams:

Figure 1:
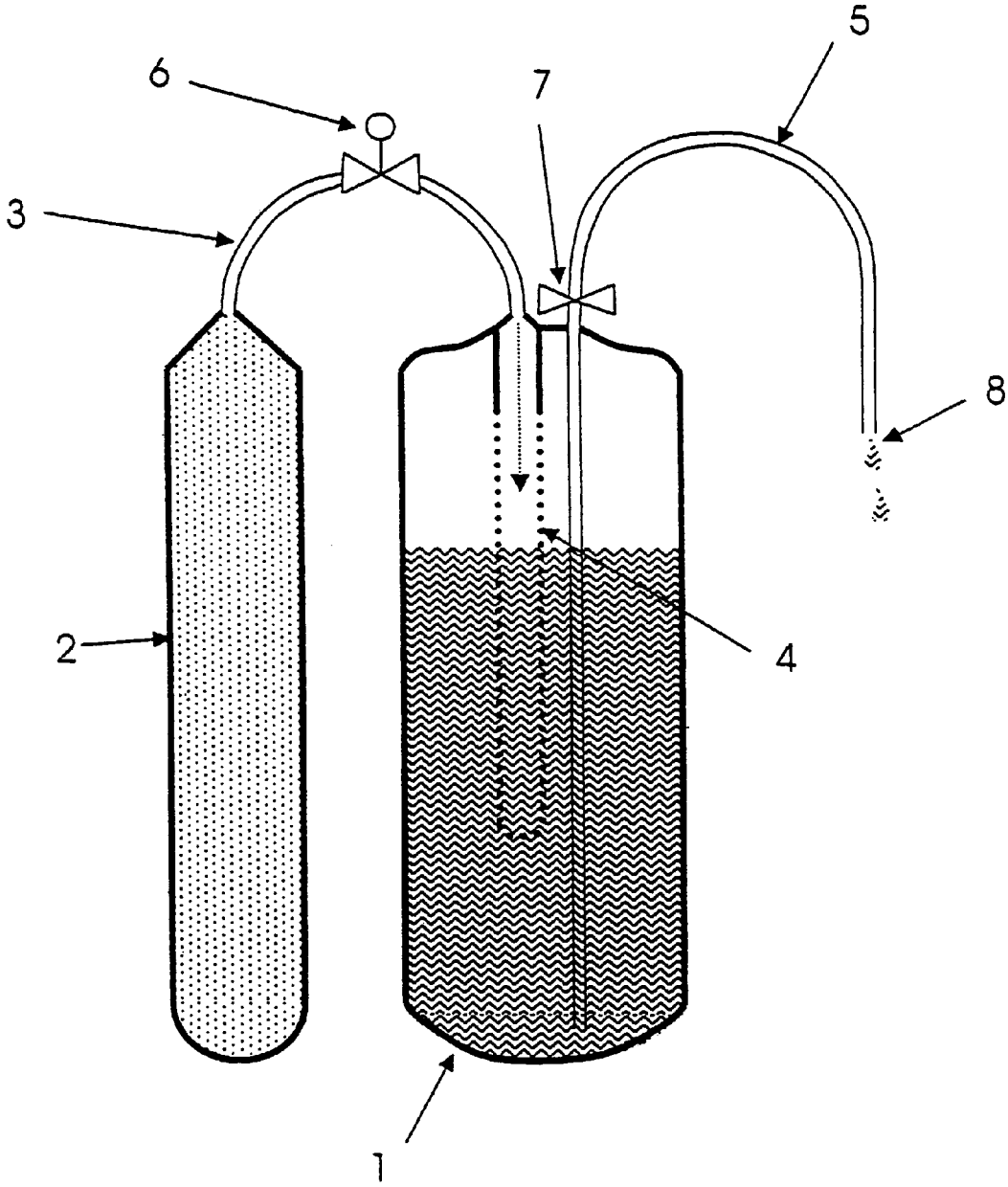
FIG. 1 shows a sectional view of an embodiment of the device.

FIG. 1 shows an embodiment of the invention, wherein the gas-supply means comprise a gas container 2, a supply line 3, a cylindrical region 4 around the gas output openings and a pressure reducer 6. With these means, the gas is supplied to the bottle-shaped container 1, in which the fluid is disposed. The cylindrical region 4 provides multiple perforations, so that the gas can flow into the fluid. This perforated region may comprise one or more walls. The fluid is accordingly enriched with the gas. An outflow 5 for the fluid is provided in the container. The fluid enriched with gas can be removed from the device at the tapping point 8. Furthermore, a valve 7 is provided, on the one hand, to interrupt the outward flow; and on the other hand, the container 1 can be sealed in a pressure-tight manner apart from the gas supply line 3, so that the gaseous enrichment can be carried out according to the physical laws of gas kinetics, thereby achieving a particularly good gaseous enrichment of the fluid. The illustrated embodiment of the device according to the invention is used especially if the supply, the gaseous enrichment and the removal of the fluid are not to be carried out continuously.

The interior of the cylindrical region 4 can be sponge-like or may be filled with perforated plates in order to realise the gaseous enrichment more effectively. Perforated plates are preferably arranged perpendicular to the direction of flow of the gas. The sponge-like structure can be realised by filling with sand.

Figure 2:
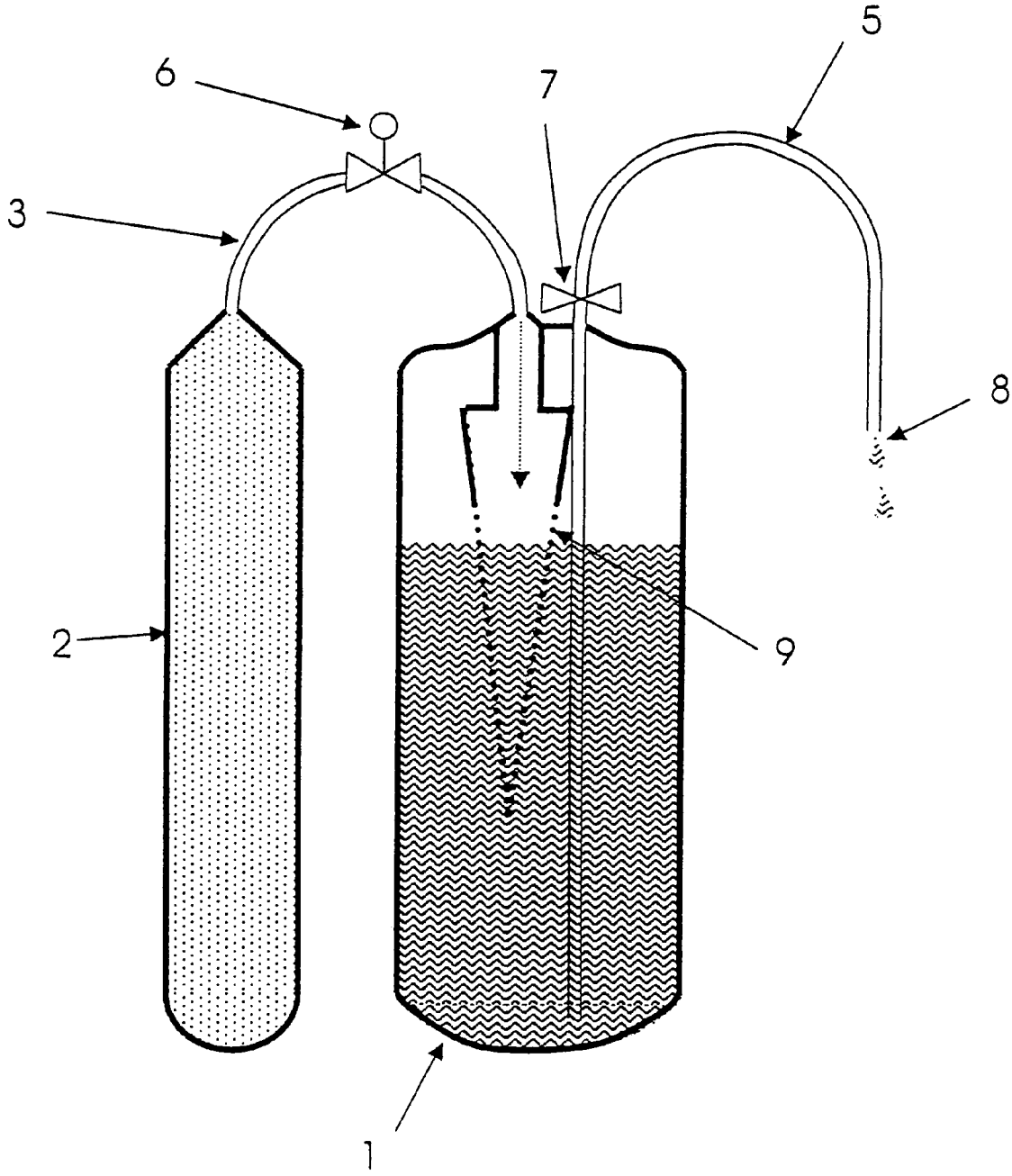
FIG. 2 shows a sectional view of another embodiment, which differs from FIG. 1 in the shape of the output region of the gas-supply means.

FIG. 2 shows a further embodiment of the invention, wherein the means for supplying the gas comprise a gas container 2, a supply line 3, a conical region 9 around the gas-output openings, and a pressure reducer 6. With these means, the gas is supplied to the bottle-shaped container 1, in which the fluid is disposed.

The conical region 9 is provided with multiple perforations, so that the gas can flow into the fluid. The conical region may have one or more walls. In particular, its interior can be designed to be sponge-like. The fluid is accordingly enriched with gas. An outflow 5 for the fluid is provided in the container 1. The fluid enriched with gas can be removed from the device at the tapping point 8. Furthermore, a valve 7 is provided, on the one hand, in order to interrupt the outward flow; on the other hand the container 1 can be sealed in a pressure-tight manner apart from the gas supply line 3, so that the gaseous enrichment can be carried out in this manner, thereby ensuring a particularly good gaseous enrichment of the fluid according to the physical laws of gas kinetics. This illustrated embodiment of the device according to the invention is used in particular, if the supply, the gaseous enrichment and the removal of the fluid are not to be carried out continuously.

Figure 3:
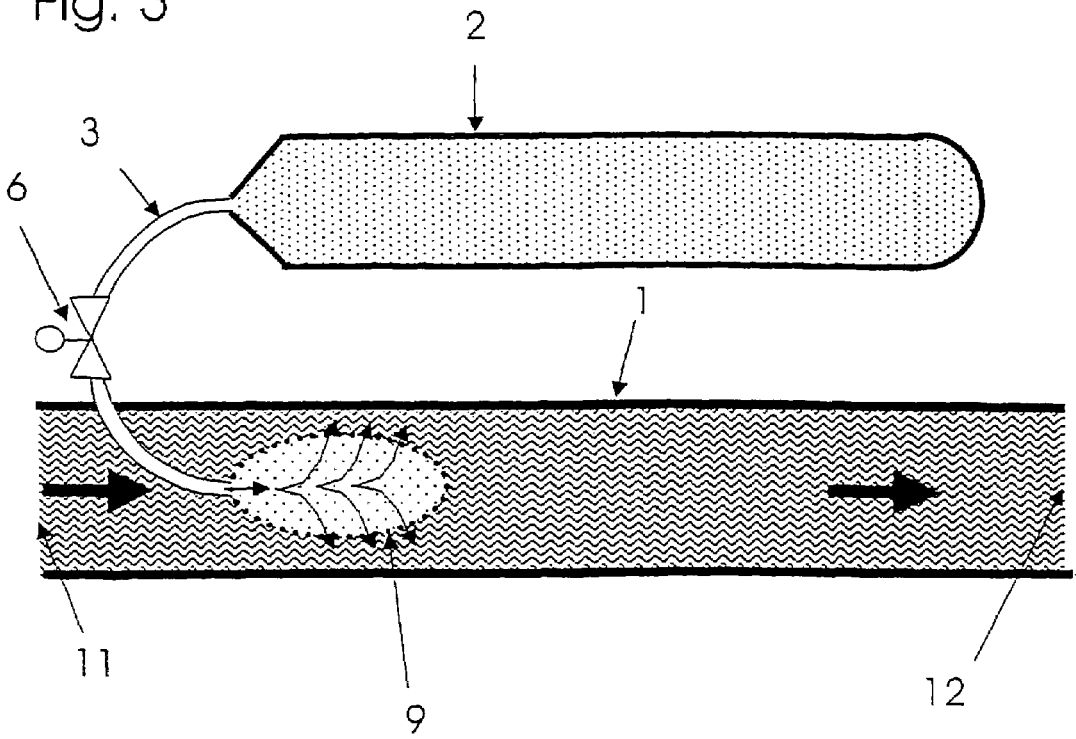
FIG. 3 shows a sectional view of a further embodiment, which differs from the preceding diagrams, inter alia, because the container comprises a fluid inlet and a fluid outflow, so that the device can be operated in a continuous process.

FIG. 3 shows a further embodiment of the device, wherein the container 1, which is tubular in this embodiment, is provided with a supply line 11 and an outflow 12 for the fluid, in order to achieve a continuous operation of the device. The gas is supplied from the gas container 2 via the supply line 3 and the pressure reducer 6 to the ellipsoidal output region 9 with its multiple perforations inside the container 1. The output region 9 may comprise one or more walls. The gas is introduced here through the output openings of the perforated region 9 into the fluid, which has flowed via the supply line 11 into the container 1. The fluid enriched in this manner is removed via the outflow 12. The output region 13 may comprise one or more walls.

Figure 4:
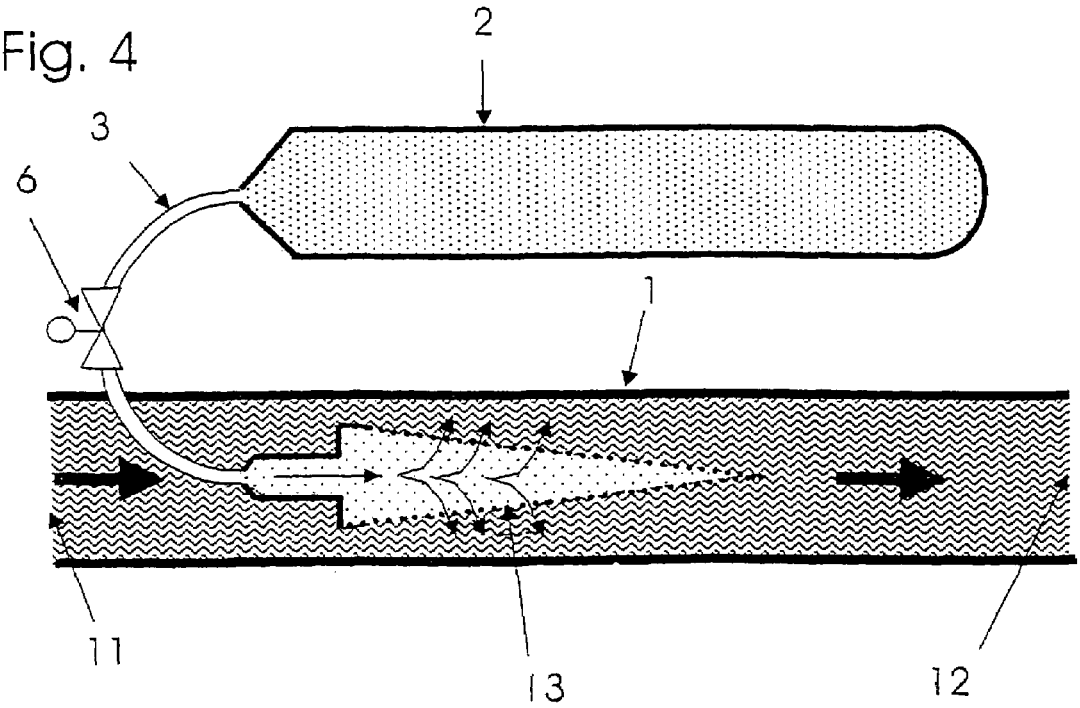
FIG. 4 shows a sectional view of a further embodiment which differs by comparison with FIG. 3 in the shape of the output region of the gas-supply means.

FIG. 4 shows a further embodiment of the device, wherein, once again, the container 1, which is tubular in this embodiment, is provided with a fluid inlet 11 and a fluid outflow 12, to allow a continuous operation of the device. The gas is supplied from the gas container 2 via the supply line 3 and the pressure reducer 6 to the output region 13, which, in this variant embodiment, is conical and provides multiple perforations inside the container 1. At this position, the gas is introduced through output openings of the perforated regions 13 into the fluid, which has been introduced via the fluid inlet 11 into the container 1. The fluid enriched in this manner is removed via the fluid outflow 12. The output region 13 may comprise one or more walls.

Figure 5:
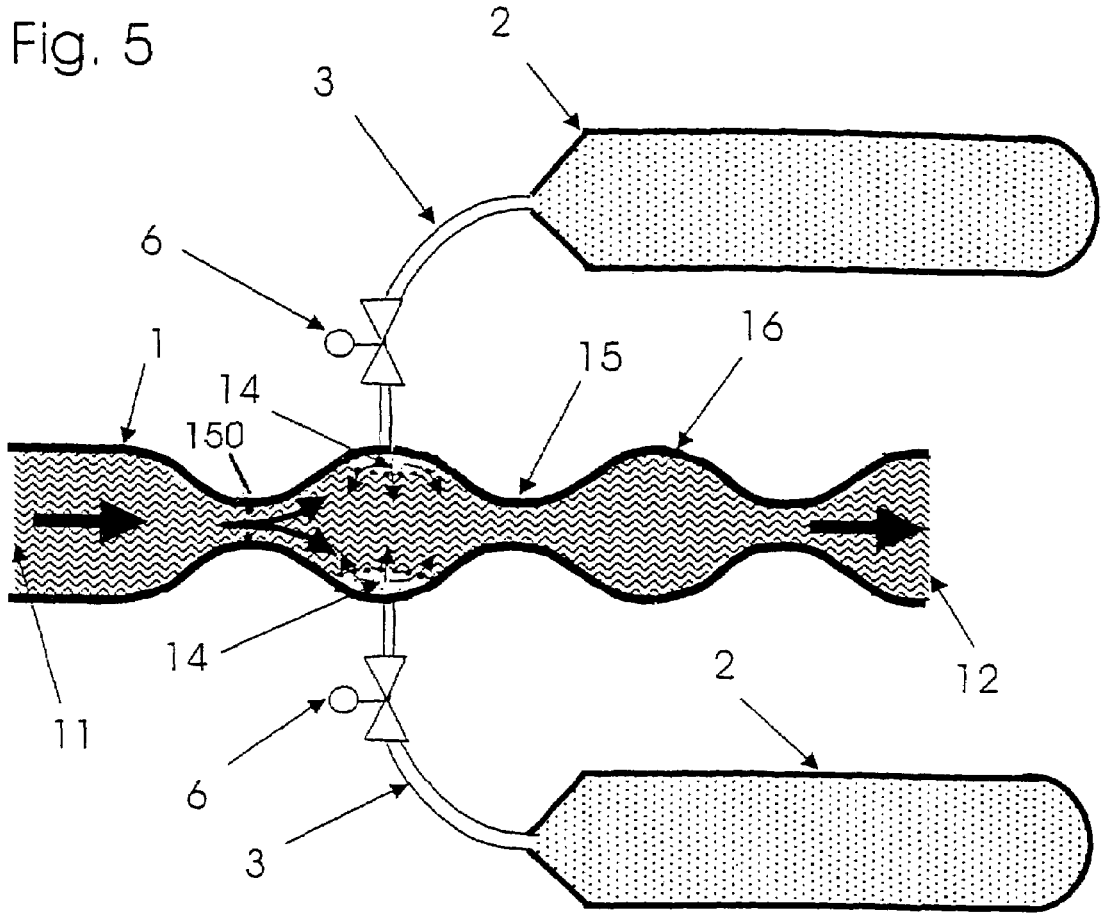
FIG. 5 shows a sectional view of a further embodiment, which differs from the previous embodiments, inter alia, in that the container comprises several narrowings, and in that gas is supplied to the container from more than one side.

FIG. 5 shows a further embodiment of the device, wherein, in addition to the fluid inlet 11 and fluid outflow 12 as illustrated, the container 1 is provided with several narrowings 15 and resulting bulge-like thickenings 16. Furthermore, two gas containers 2, two supply lines 3, two pressure reducers 6 and two gas output regions 14 are provided. As a result, in addition to providing gaseous enrichment from more than one side, which is therefore effective, it is possible to enrich the fluid with different gases. The gas is supplied from each gas container 2 via the supply line 3 and the pressure reducer 6 to the output region 14, which, in this variant, is designed in the form of a nozzle and provides multiple perforations inside the container 1. Each gas is introduced through output openings of the perforated region 14 into the fluid, which has been introduced into the container 1 via the fluid inlet 11. The fluid enriched in this manner is removed via the outflow 12. The output regions 14 in this embodiment are arranged in the bulge-like thickening of the container 1. Because of the expanded cross-section, the fluid flows in a targeted manner after the narrowing 15 towards the gas output regions 14, as shown by the arrows in the drawing. As a result, the gaseous enrichment is particularly effective.

Figure 6:
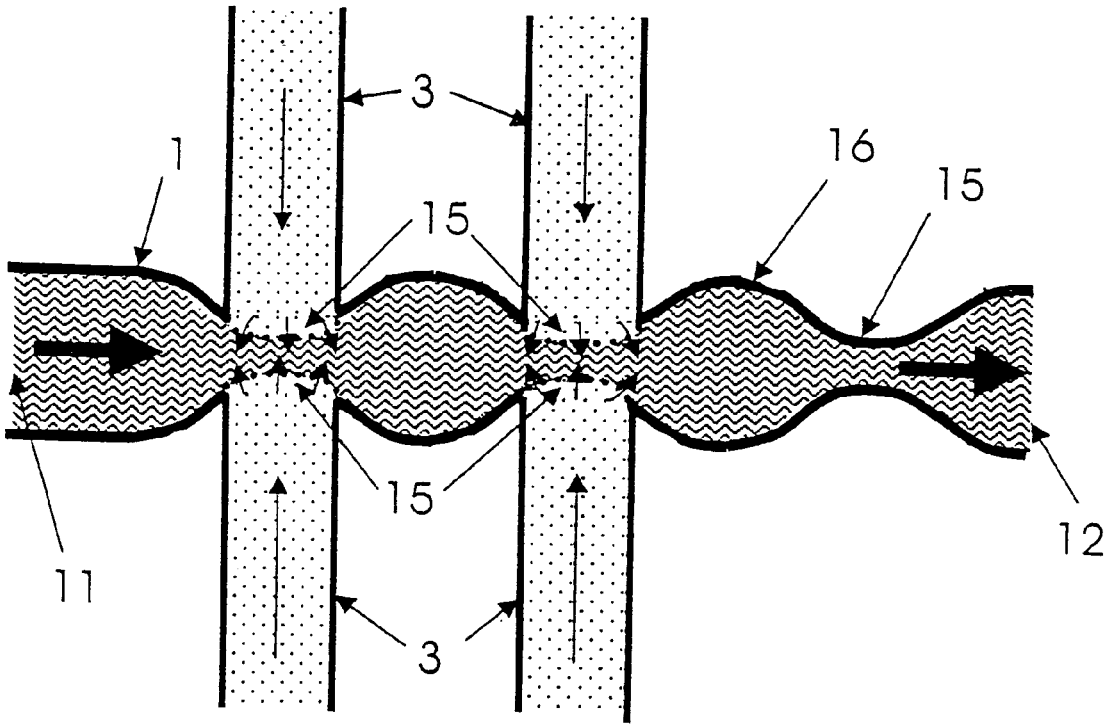
FIG. 6 shows a sectional view of a further embodiment, in which, by contrast with FIG. 5, the gas output openings are arranged in the region of the narrowings in the container.

FIG. 6 shows a further embodiment of the device, wherein, in addition to the fluid inlet 11 and the fluid outflow 12, the container 1 as illustrated is also provided with several narrowings 15 and resulting bulge-like thickenings 16. Above this, several gas supply lines 3 are provided, by means of which one or more different gases are introduced via output regions 15 disposed inside the container 1. In this variant, the output regions 15 are arranged in the narrowings of the container 1. The resulting reduction in cross-section causes a local increase in the flow rate of the fluid, thereby achieving a more effective gaseous enrichment. The gas container is not illustrated, because the type of storage of the gas and/or the source of the gas is not relevant to the embodiment shown. Furthermore, the gas-liquid mixture is compressed, which leads to a more effective gaseous enrichment.

Figure 7:
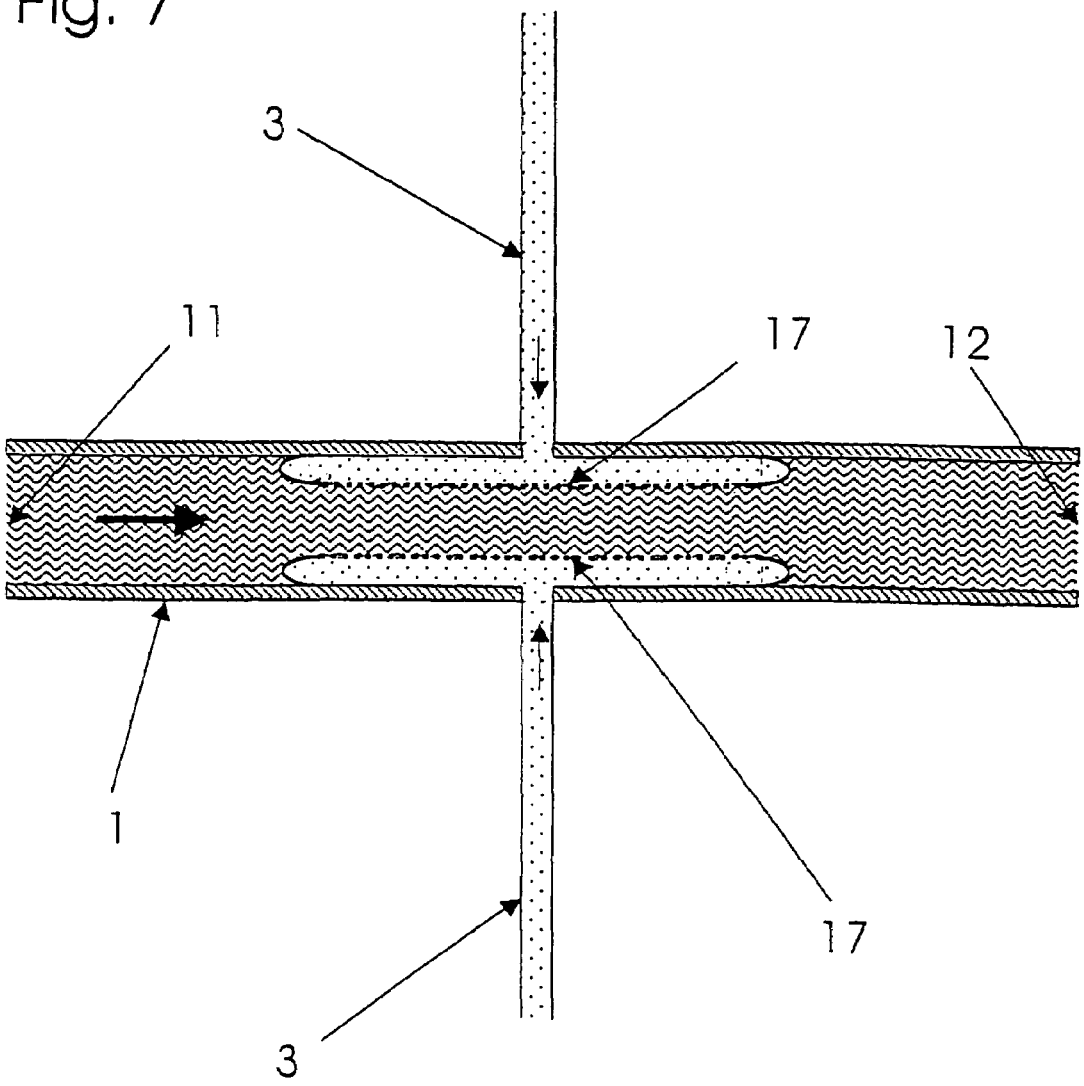
FIG. 7 shows a sectional view of a further embodiment of the device according to the invention.

FIG. 7 shows a further variant embodiment of the invention, which comprises a tubular container 1 provided with a fluid inlet 11 and a fluid outflow 12. The gaseous enrichment takes place from two sides relative to the container 1 via each of the gas supply lines 3 and the multiple perforations of the cylindrical output regions 17.

Figure 8:
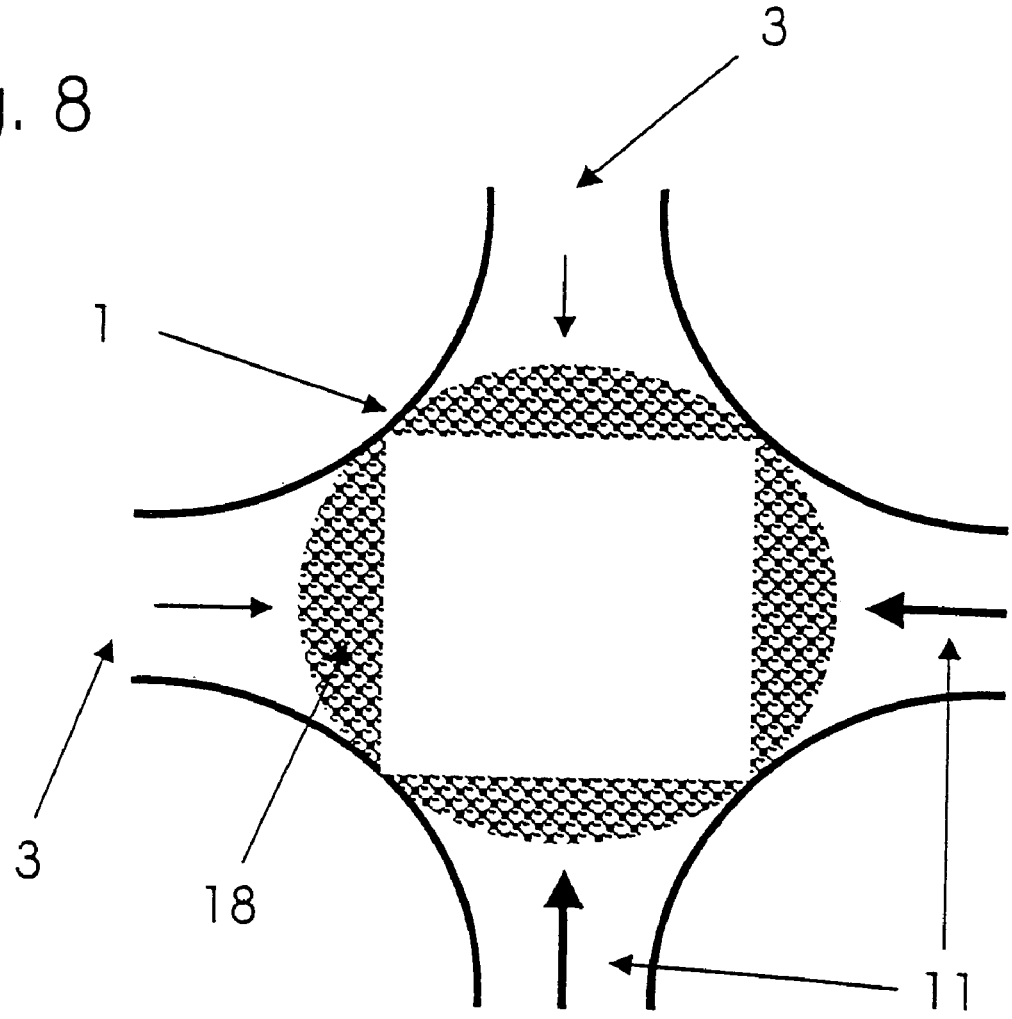
FIG. 8 shows a transverse section through a container in a further embodiment with a double gas-supply line and double fluid-supply line.

FIG. 8 shows a sectional view through a container 1 in a further embodiment with a double gas supply 3 and a double inlet 11 for the fluid. In each case, nozzle-like output regions 18, through which the fluid is enriched with gas, are arranged together in a star shape.

Figure 9:
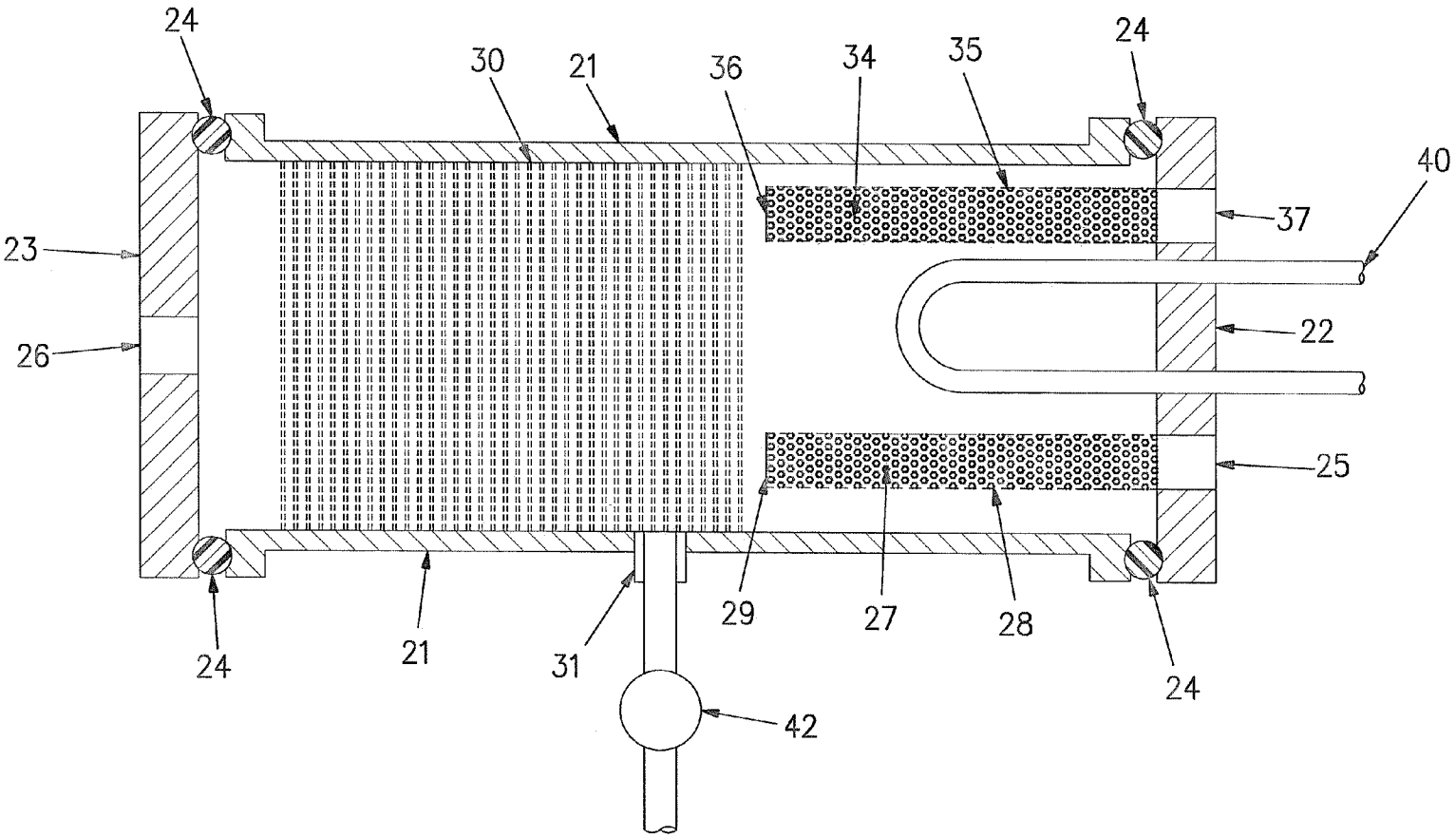
FIG. 9 shows a transverse section of a further embodiment of the invention, wherein the container is designed in tubular form, and the fluid-supply and gas-supply means respectively comprise perforated output portions.

FIG. 9 shows a transverse section through a container 21 in a further embodiment of the invention. The end faces of the tubular container 21 are provided with covers 22, 23, which seal the tubular container in a pressure-tight manner by means of sealing rings 24. In an alternative development of the container according to the invention, the container comprises only one removable cover, while the tubular container and the other cover are designed in one piece. In the embodiment illustrated, the container 21 is 180 mm long, with an internal diameter of 50 mm, a wall thickness of 1.6 mm and is manufactured from V2A steel of type 1.4401. The container 21 is subdivided into volumetric portions by means of walls 30 with multiple perforations. The circular walls 30 are manufactured from stainless steel wire mesh framed by folded sheet steel. The walls 30 are oriented parallel to the covers 22, 23 and, after removal of the covers 22 or 23, can easily be inserted into the container 21 or removed from the container 21 for cleaning purposes or in order to adapt the required level of gaseous enrichment. For instance, 86 walls 30 made from two sorts of wire mesh are used with mesh sizes (perforation diameter) of 64 μm and 0.1 mm respectively. The two sorts of walls 30 are fitted into the container 21 in an alternating sequence in order to achieve an effective gaseous enrichment. The fluid is supplied to the container 21 via the opening 25 in the cover 22. Furthermore, the fluid-supply means provide a tubular element 28 of approximately 9 cm length and 2.5 cm external diameter, of which the casing 27 comprises several layers. In its interior, the casing 27 consists of coarse (coarsely perforated) stainless steel mesh of 2 mm perforation diameter (mesh size) in order to stabilize the structure, a layer of more finely perforated wire mesh with 0.4 mm mesh size disposed above this, and a layer of extremely finely perforated wire mesh with 0.60 μm mesh size. Otherwise, no output openings for fluid are provided in the container 21. Accordingly, one end 29 of the tube 28 is closed, and the fluid, which is introduced into the tube 28 at the other end, is forced to flow into the container 21 through the perforated casing 27 of the tube 28.

The gas is supplied to the container 21 through the opening 37 in the cover 22. Furthermore, the gas-supply means comprise a tubular element 35 of approximately 9 cm length and 2.5 cm external diameter, of which the casing 34 comprises several layers. In its interior, the casing 34 consists of coarse (coarsely perforated) stainless steel wire mesh of 2 mm perforation diameter (mesh size) in order to stabilise the structure, a layer of a finely perforated wire mesh of 0.4 mm mesh size disposed above this, and a layer of an extremely finely perforated wire mesh with 0.60 μm mesh size. Otherwise no output openings into the container 21 are provided for gas. Accordingly, one end 36 of the tube and 35 is closed, and the gas, which is introduced at the other end of the tube 35, is therefore forced to flow into the container 21 through the perforated casing 34 of the tube 35.

The tubular elements of the gas and/or fluid supply means are each disposed parallel to the casing of the tubular container 21, in order to achieve an effective gaseous enrichment in the fluid surrounding the tubular supply elements. The flow conditions and turbulence in the fluid resulting from the design and arrangement are particularly favourable for an effective gaseous enrichment.

Alternatively or additionally, gas can be supplied to the container 21 through the opening 31, which is a component of the gas-supply means, and then added to the fluid with the assistance of the turbulence and/or flow conditions created at the perforated walls 30 in combination with the output openings of the tubular supply means 28, 35. The opening 31 can be arranged as illustrated, in the centre of the container 21. In an alternative embodiment not illustrated here, the opening 31 is arranged in the region of the tubular gas and/or fluid supply elements, thereby achieving a gaseous enrichment different from the embodiment illustrated in FIG. 9 with an opening 31 disposed centrally. The enriched fluid can be removed from the container 21 via the outflow 26, which is provided as an opening in the cover 23. With the embodiment of the invention described above, for example, with drinking water supplied at 1.9 bar, an oxygen enrichment of 52 mg/litre can be achieved at 19° C., or an enrichment of 72 mg/litre can be achieved at 12° C. The gaseous enrichment conditions can therefore be adjusted by selecting the pressure and temperature conditions.

Figure 10:
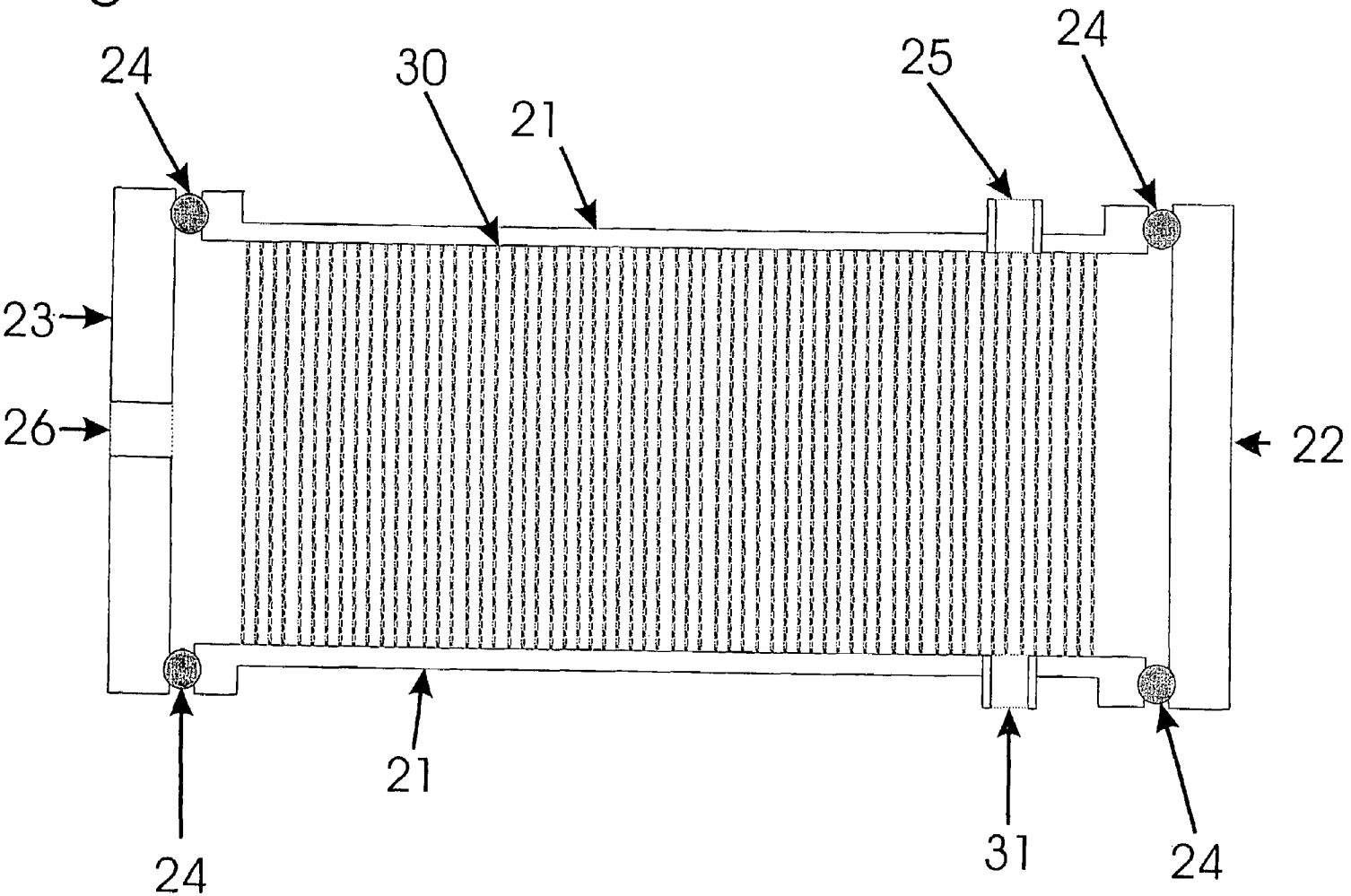
FIG. 10 shows a transverse section of a further embodiment of the invention, wherein, by contrast with the embodiment shown in FIG. 9, the tubular, perforated output portions are dispensed with, but instead, the container is more extensively provided with perforated walls.

FIG. 10 shows a transverse section through a container 21 in a further embodiment of the invention. The ends of the tubular container 21 are fitted with covers 22, 23, which close the tubular container in a pressure-tight manner via sealing rings 24. The container 21 is, for example, 180 mm long with an internal diameter of 63 mm and a wall thickness of 1.6 mm and is manufactured from V2A steel of type 1.4404. The container 21 is subdivided into volumetric portions by walls 30 with multiple perforations. The circular walls 30 are manufactured from stainless steel wire mesh framed by folded sheet steel. The walls 30 are arranged parallel to the covers 22, 23 and, after removing the cover 22 or 23, can easily be introduced into the container 21 or removed from the container 21 for cleaning purposes or in order to adapt the required level of gaseous enrichment. The fluid is supplied to the container 21 via the opening 25 in the container 21. The gas is supplied to the container 21 through the opening 31, which is a component of the gas-supply means and then added to the fluid with the assistance of the turbulence and/or flow conditions created at the perforated walls 30. The fluid enriched in this manner can be removed from the container 21 via the outflow 26, which is provided as an opening in the cover 23.

Figure 11:
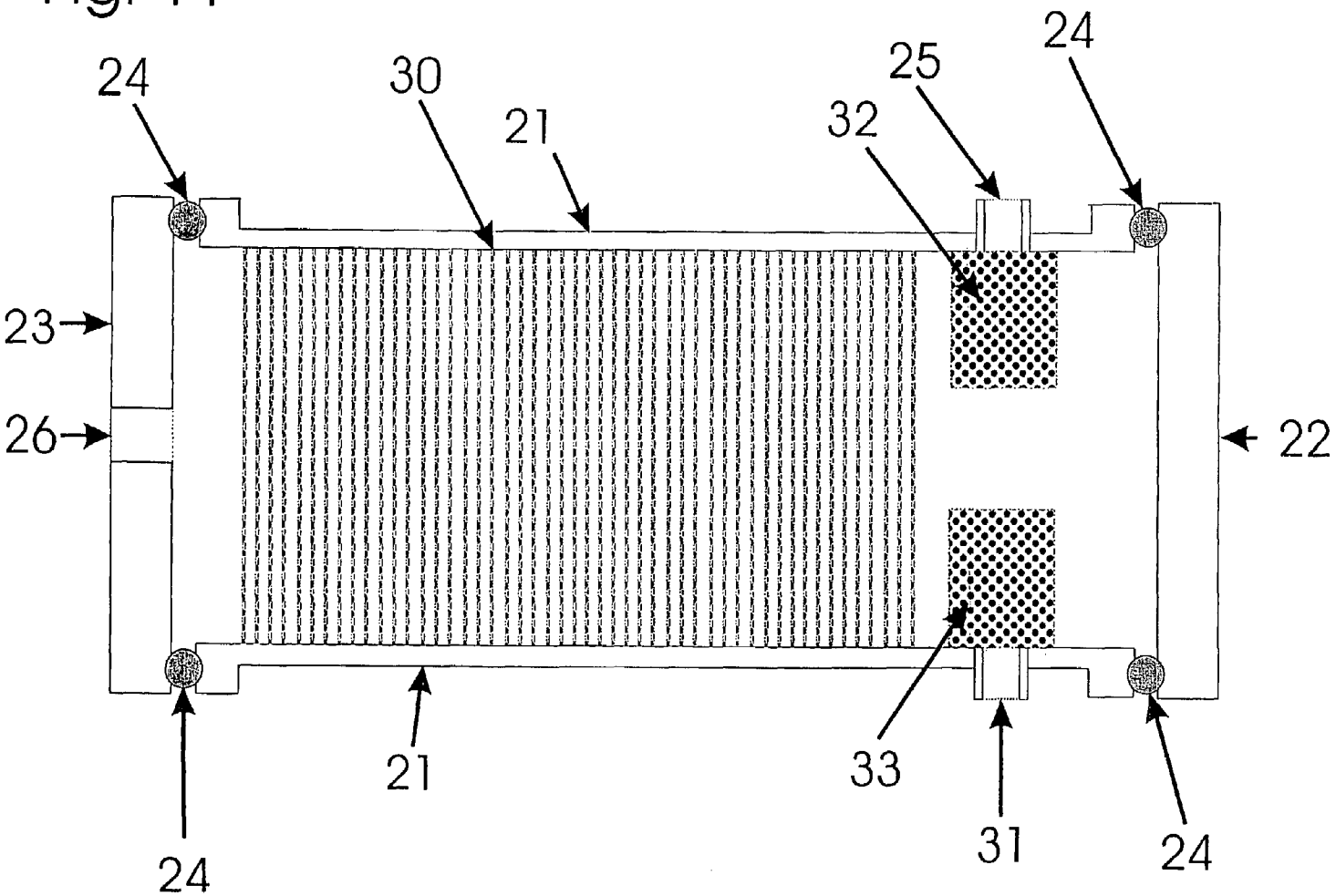
FIG. 11 shows a transverse section of a further embodiment of the invention, wherein, by contrast with the embodiment shown in FIG. 9, the gas-supply means also comprise tubular, perforated output portions.

FIG. 11 shows a transverse section through a container 21 in a further embodiment of the invention. The ends of tubular container 21 are fitted with covers 22, 23, which close the tubular container in a pressure-tight manner via sealing rings 24. The container 21 is subdivided into volumetric portions by walls 30 with multiple perforations. The circular walls 30 are manufactured from stainless steel wire mesh framed by folded sheet steel. The walls 30 are arranged parallel to the covers 22, 23 and, after removing the cover 22 or 23, can easily be introduced into the container 21 or removed from the container 21 for cleaning purposes or in order to adapt the required level of gaseous enrichment. The fluid is supplied to the container 21 via the opening 25 in the container 21. Furthermore, the fluid-supply means comprise a tubular element 32, of which the casing is provided with multiple perforations forming output openings. Alternatively, corresponding to an embodiment which is not illustrated, the elements 32 can be designed in the form of a sphere, an ellipsoid or a cuboid. The gas is supplied to the container 21 through the opening 31. Furthermore, the gas-supply means comprise a tubular element 33, of which the casing is provided with multiple perforations forming output openings. Alternatively, corresponding to an embodiment, which is not illustrated, the element 33 can be designed in the form of a sphere, an ellipsoid or a cuboid. The gas is added to the fluid with the assistance of the turbulence and/or flow conditions produced at the perforated walls 30 in combination with the output openings of the tubular fluid-supply means 32 and gas-supply means 33. The fluid enriched in this manner can be removed from the container 21 via the outflow 26, which is provided as an opening in the cover 23.

Figure 12:
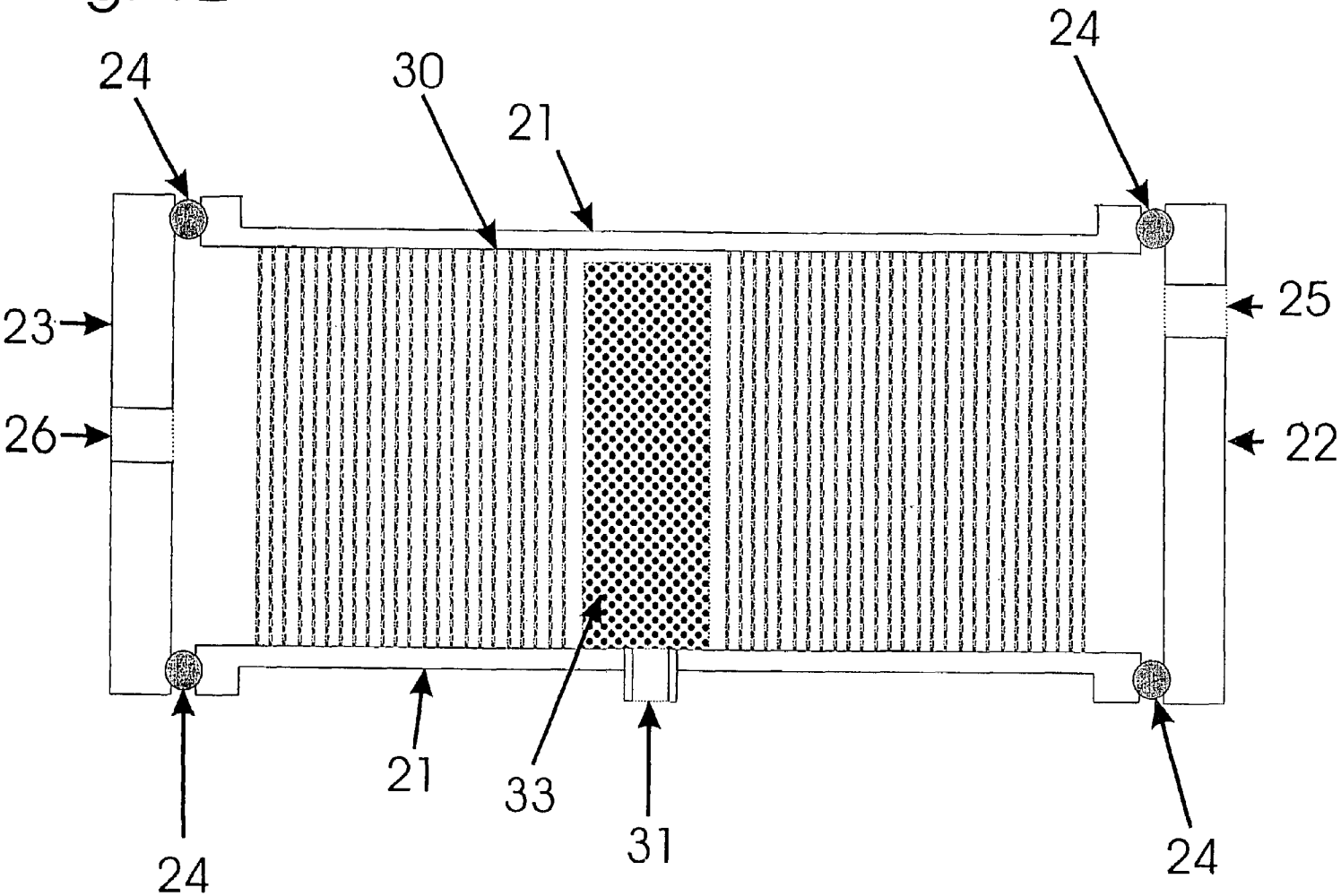
FIG. 12 shows a transverse section of a further embodiment of the invention wherein, by contrast with the embodiment shown in FIG. 9, only the gas-supply means comprise tubular, perforated output portions.

FIG. 12 shows a transverse section through a container 21 in a further embodiment of the invention. The ends of the tubular container 21 are fitted with covers 22, 23, which close the tubular container in a pressure-tight manner via sealing rings 24. The container 21 is subdivided into volumetric portions by walls 30 with multiple perforations. The circular walls 30 are manufactured from stainless steel wire mesh framed by folded sheet steel. The walls 30 are arranged parallel to the covers 22, 23 and, after removing the cover 22 or 23, can easily be introduced into the container 21 or removed from the container 21 for cleaning purposes or in order to adapt the required level of gaseous enrichment. The fluid is supplied to the container 21 via the opening 25 in the container 21. The gas is supplied to the container 21 through the opening 31 in the container 21. Furthermore, the gas-supply means comprise a tubular element 33, of which the casing is provided with multiple perforations forming output openings. The gas is added to the fluid with the assistance of the turbulence and/or flow conditions produced at the perforated walls 30 in combination with the output openings of the tubular fluid supply means 32 and gas-supply means 33 arranged centrally in the container 21. The fluid enriched in this manner can be removed from the container 21 via the outflow 26, which is provided as an opening in the cover 23.

Figure 13:
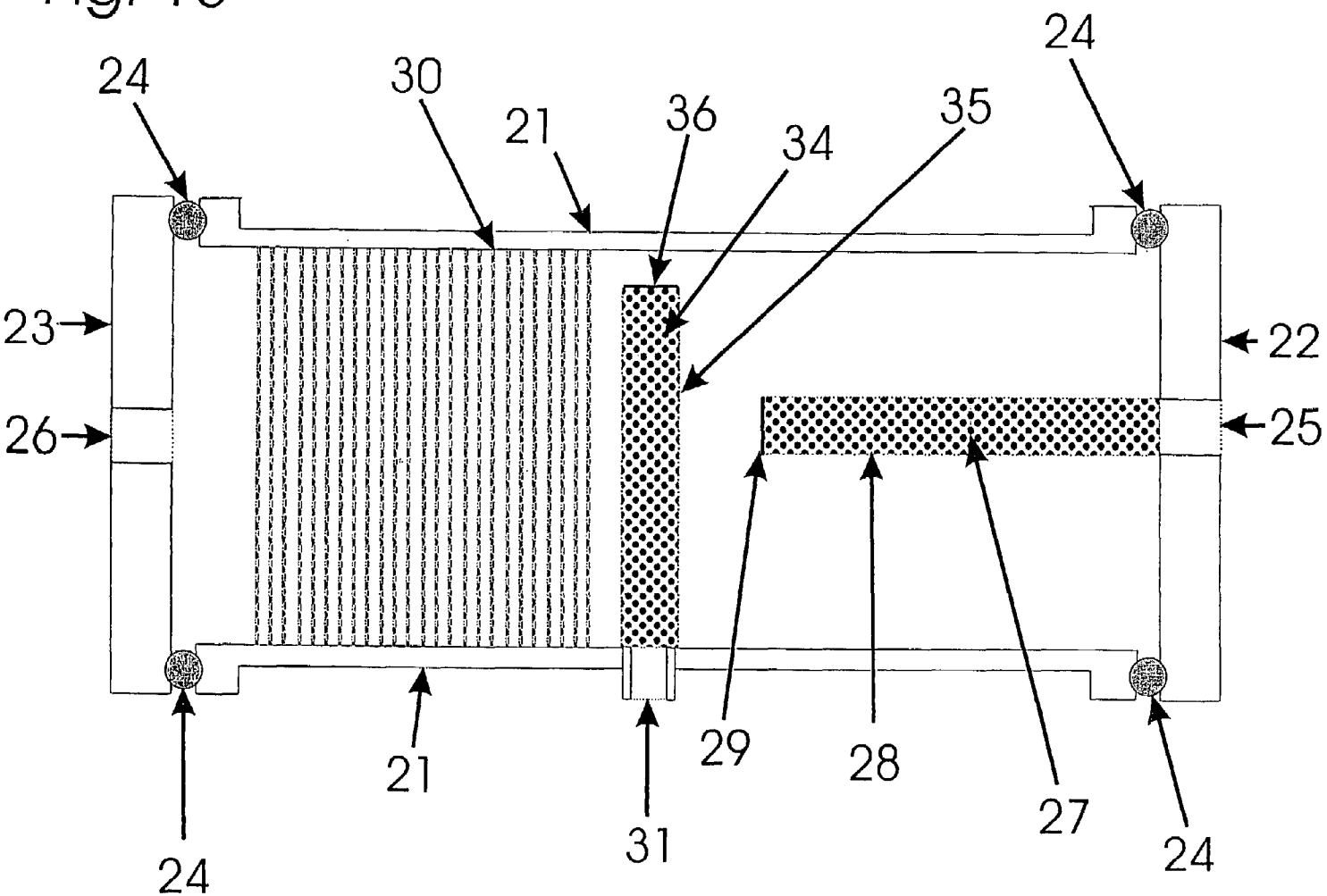
FIG. 13 shows a transverse section of a further embodiment of the invention, wherein, by contrast with the embodiment shown in FIG. 9, only-the gas-supply and fluid-supply means are arranged at right angles to one another.

FIG. 13 shows a transverse section through a container 21 in a further embodiment of the invention. The ends of the tubular container 21 are fitted with covers 22, 23, which close the tubular container in a pressure-tight manner via sealing rings 24. The container 21 is subdivided into volumetric portions by walls 30 with multiple perforations. The circular walls 30 are manufactured from stainless steel wire mesh framed by folded sheet steel. The walls 30 are arranged parallel to the covers 22, 23 and, after removing the cover 22 or 23, can easily be introduced into the container 21 or removed from the container 21 for cleaning purposes or in order to adapt the required level of gaseous enrichment. Furthermore, the fluid-supply means comprise a tubular element 28, of which the casing 27 is provided with multiple, sieve-like perforations forming output openings for the fluid into the container 21. Otherwise, no output openings for fluid are provided in the container 21. Accordingly, one end 29 of the tube 28 is closed, and the fluid, which is introduced at the other end of the tube 28, is therefore forced to flow into the container 21 through the perforated casing 27 of the tube 28.

The gas is supplied to the container 21 via the opening 31. Furthermore, the gas-supply means comprise a tubular element 35, of which the casing 34 provides sieve-like, multiple perforations forming output openings for the gas into the container 21. Otherwise, no output openings for gas are provided in the container 21. Accordingly, one end 36 of the tube 35 is closed, and the gas, which is introduced at the other end of the tube 35, is therefore forced to flow into the container 21 via the perforated casing 34 of the tube 35.

The tubular elements of the gas-supply and fluid-supply means respectively are each arranged at right angles to one another in order to achieve an effective gaseous enrichment in the fluid surrounding the tubular supply elements. The flow conditions and turbulence produced in the fluid as a result of this design and arrangement are particularly favourable for an effective gaseous enrichment. The enriched fluid can be removed from the container 21 via the outflow 26, which is provided as an opening in the cover 23.

A sieve 150 with very fine mesh is advantageously disposed between two bulge-like thickenings 16 in order to improve the gaseous enrichment.

Figure 14:
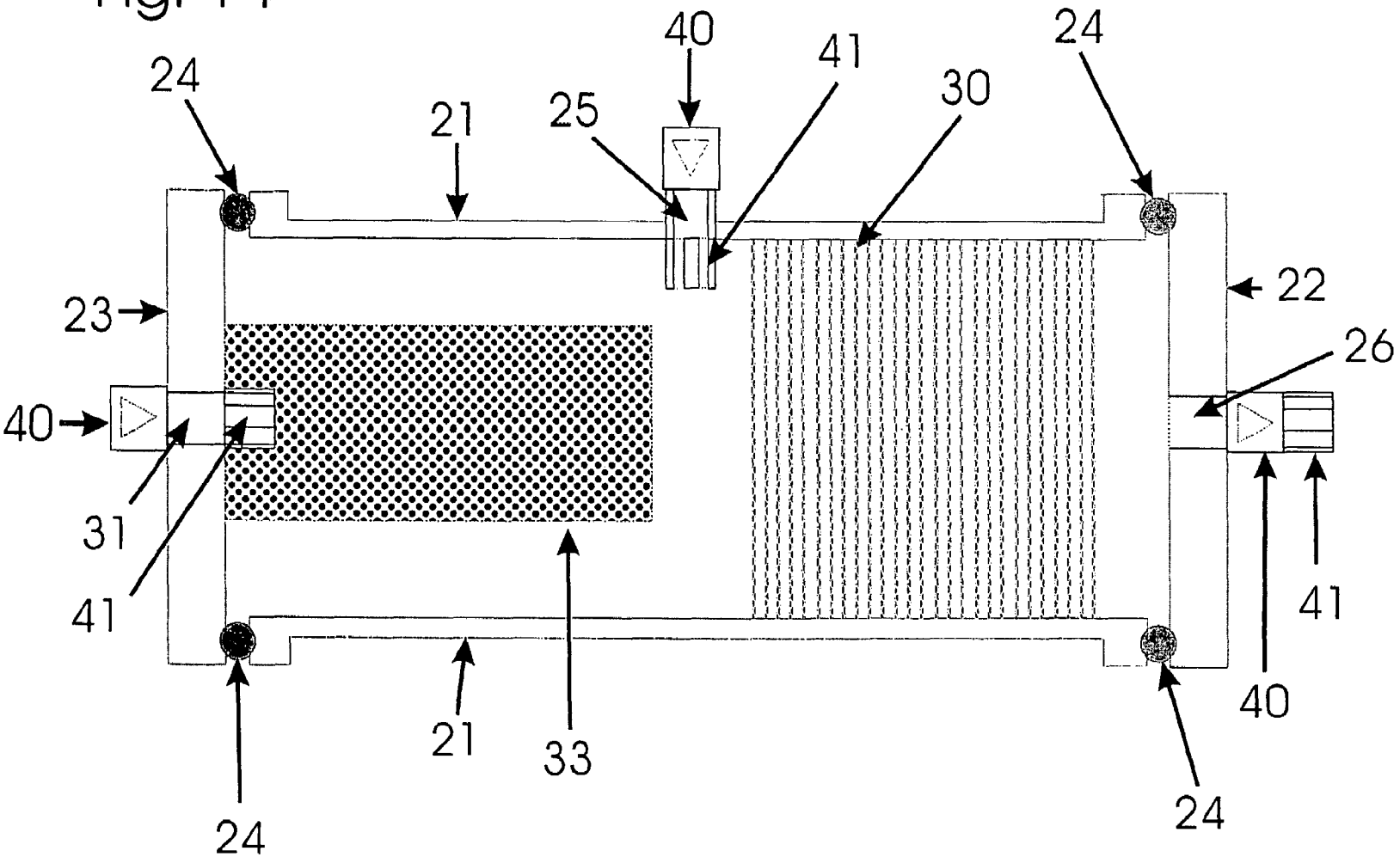
FIG. 14 shows a transverse section of a further embodiment of the invention, wherein, inter alia, the gas-supply means, the fluid-supply means and the fluid outflow each comprise a non-return valve and a swirl nozzle.

FIG. 14 shows a further embodiment of the invention. This provides a tubular container 21, which is closed at the ends in a pressure-tight manner by the covers 22, 23. The container 21 is fitted with walls 30 with multiple perforations in such a manner that the container 21 is subdivided into volumetric portions. The circular walls 30 are manufactured from stainless steel wire mesh framed by folded sheet steel. The walls 30 are arranged parallel to the covers 22, 23 and, after removing the cover 22 or 23, can easily be introduced into the container 21 or removed from the container 21 for cleaning purposes or in order to adapt the required level of gaseous enrichment. The fluid is supplied to the container 21 through the opening 25. The supply means for the fluid comprise a non-return valve 40. This allows a depressurised connection and/or disconnection of the device from the lines supplying the fluid. The non-return valve can optionally also be combined with the other embodiments described above. Furthermore, the fluid-supply means comprise a swirl nozzle 41. This improves the gaseous enrichment by intensifying the turbulence of the fluid introduced. This additional effect can also be achieved in the other embodiments described above by providing a swirl nozzle 41. The gas is supplied to the container 21 via the opening 31 in the cover 23. The gas-supply means comprise a tubular element 33, the casing of which provides multiple, sieve-like perforations forming output openings for the gas into the container 21. The supply means for the gas comprise a non-return valve 40. This allows a depressurised connection and/or disconnection of the device from the lines supplying the gas. Furthermore, a swirl nozzle 41, which guarantees an intensified turbulence of the gas entering the container 21, is provided at the output opening 31. The tubular element of the gas-supply means is orientated at right angles to the fluid-output opening in order to achieve an effective gaseous enrichment in the container 21. The flow conditions and turbulence in the fluid resulting from this design and arrangement are particularly favourable for an effective gaseous enrichment. The enriched fluid can be removed from the container 21 via the outflow 26, which is provided as an opening in the cover 22. In order to avoid a disadvantageous return flow of enriched fluid into the container 21, a non-return valve 40 is also provided at the outflow 26. Another swirl nozzle 41 arranged after the outflow 26 provides an additional, advantageous turbulence in the enriched fluid.

Figure 15:
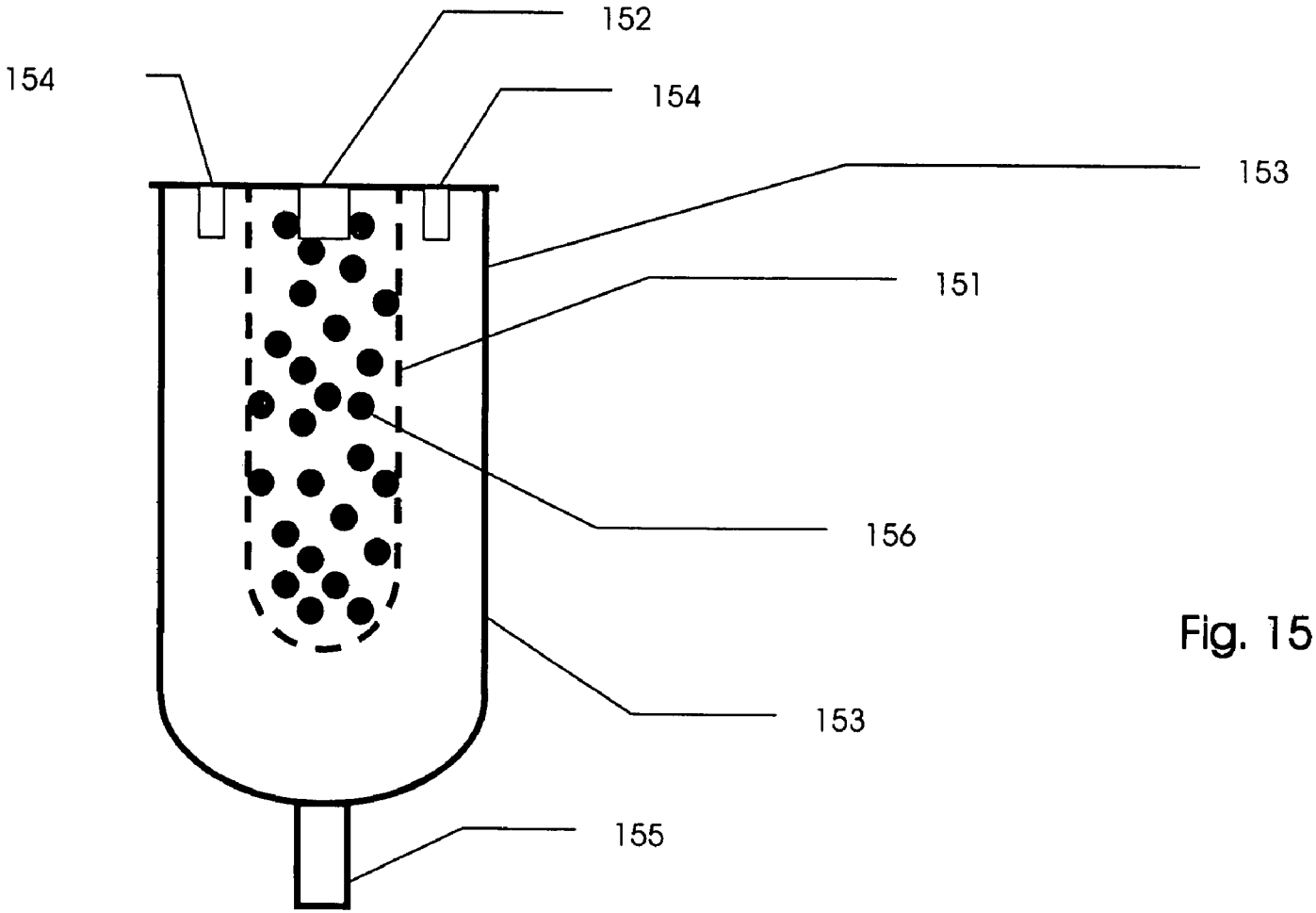
FIG. 15 shows a transverse section of a further embodiment of the invention, in which a sponge-like structure is used.

The embodiment illustrated in FIG. 15 shows a bottle-like inner container 151, which comprises a gas-supply line 152 at one end. The container 151 is provided with at least one perforated wall. The fluid is supplied to an outer container 153 via supply lines 154, which can comprise swirl nozzles. An outflow 155, which can be closed, is provided at the opposite end. The walls of the container 153 can be permeable to photons, so that the contents can be irradiated with photons to improve the desired effects. The inner container 151 is provided with sand 156 or perforated layers.

The invention can be provided for extremely small devices as well as for medium-sized or large industrial plants. It can be realised with different dimensions.

What is claimed is:

1. A device for gaseous enrichment of fluids, comprising
a container for a fluid;
means for supplying a gas to the container to provide a flow of gas;
means for supplying the fluid to the container; and
a fluid outflow;
wherein the means for supplying the gas and the means for supplying the fluid each comprise tubular perforated output portions;
wherein the container comprises a plurality of volumetric portions and a plurality of walls between the volumetric portions, the walls including a plurality of differently sized perforations between the volumetric portions;
wherein the flow of gas moves in a particular direction; and
wherein the plurality of walls are generally arranged parallel to the direction of flow of the gas.

2. The device of claim 1, comprising at least two sorts of walls, the walls comprising a plurality of different perforations, said walls being spatially arranged in an alternating manner within the container.

3. The device of claim 1, wherein the means for supplying the fluid and the means for supplying the gas each are designed in a tubular form, and the portions, which provide multiple perforations forming output openings, are arranged in the casing of the tubes, and wherein no further output openings are provided.

4. A device for gaseous enrichment of fluids, comprising:
a tubular container for a fluid;
means for supplying a gas to the container to provide a flow of gas;
means for supplying the fluid to the container; and
a fluid outflow;
wherein the means for supplying the gas and the means for supplying the fluid each comprise tubular perforated output portions,
wherein the container comprises a plurality of volumetric portions and a plurality of different sorts of walls between the volumetric portions, said walls including a plurality of differently sized perforations between the volumetric portions, said walls being spatially arranged in an alternating manner within the container,
wherein the flow of gas moves in a particular direction, and
wherein the plurality of walls are generally arranged parallel to the direction of flow of the gas.

5. A device for gaseous enrichment of fluids, comprising
a container for a fluid;
means for supplying a gas to the container to provide a flow of gas;
means for supplying the fluid to the container; and
a fluid outflow;
wherein the means for supplying the gas and the means for supplying the fluid each comprise tubular perforated output portions;
wherein the container comprises a plurality of volumetric portions and a plurality of walls between the volumetric portions, the walls including a plurality of differently sized perforations between the volumetric portions;
wherein the flow of gas moves in a particular direction;
wherein the plurality of walls are generally arranged parallel to the direction of flow of the gas; and
wherein the container comprises V2A steel.

6. The device of claim 1, wherein the device comprises electro-polished steel.

7. The device of claim 1, wherein the container is pressure-tight.

8. The device of claim 1, further comprising means for cooling.

9. The device of claim 1, wherein the means for supplying the gas substantially has a form selected from the group consisting of cylinder, cone, spiral, ellipsoid, sphere, funnel, nozzle or wave in the region around the gas output openings.

10. The device of claim 1, wherein the means for supplying the gas includes a manometer.

11. A method of enriching a fluid with a gas, comprising using the device of claim 1, to add a gas to a fluid.

12. The method of claim 11, wherein a fluid is continuously supplied for gaseous enrichment and gas-enriched fluid continuously flows out from the device.

13. A method of forming a medicinal preparation, comprising enriching a fluid with a gas using the device of claim 1 to form a gas-enriched fluid.

14. The device of claim 1, wherein the means for supplying a gas to the container and the means for supplying the fluid to the container are substantially parallel to one another.

15. The device of claim 1, further comprising a second means for supplying a gas to the container.

16. The device of claim 1, wherein the walls are substantially parallel to one another.

17. A device for gaseous enrichment of fluids, comprising a container for a fluid;

means for supplying a gas to the container;

means for supplying the fluid to the container; and a fluid outflow;

wherein the means for supplying the gas and the means for supplying the fluid each comprise tubular perforated output portions;

wherein the container comprises a plurality of volumetric portions and a plurality of walls between the volumetric portions, the walls including a plurality of differently sized perforations between the volumetric portions; and wherein the tubular perforated output portions are substantially parallel to one another.

18. The device of claim 17, wherein the walls are substantially parallel to one another.

19. The device of claim 17, wherein the tubular perforated output portions are substantially perpendicular to the plurality of walls.

* * * * *